US006854670B2

(12) United States Patent
Sumisha et al.

(10) Patent No.: US 6,854,670 B2
(45) Date of Patent: Feb. 15, 2005

(54) FUEL INJECTION VALVE

(75) Inventors: Noriaki Sumisha, Miyagi (JP); Ryohei Kimura, Miyagi (JP); Kazuhiko Sato, Miyagi (JP); Shunsuke Inagaki, Miyagi (JP); Kenichi Sato, Miyagi (JP)

(73) Assignee: Keihin Corporation, Tokyo (JP)

( * ) Notice: Subject to any disclaimer, the term of this patent is extended or adjusted under 35 U.S.C. 154(b) by 74 days.

(21) Appl. No.: 10/435,679

(22) Filed: May 12, 2003

(65) Prior Publication Data

US 2003/0234005 A1 Dec. 25, 2003

(30) Foreign Application Priority Data

May 17, 2002 (JP) ..... 2002-143673
May 17, 2002 (JP) ..... 2002-143674
May 17, 2002 (JP) ..... 2002-143675

(51) Int. Cl.[7] ..... F02M 51/00; B05B 1/30
(52) U.S. Cl. ..... 239/533.12
(58) Field of Search ..... 239/533.1, 533.3, 239/533.7, 533.12, 533.14

(56) References Cited

U.S. PATENT DOCUMENTS 5,875,972 A * 3/1999 Ren et al. ..... 239/463
6,145,761 A * 11/2000 Muller et al. ..... 239/533.12
6,161,782 A * 12/2000 Heinbuck et al. ..... 239/585.1
6,494,388 B1 * 12/2002 Mueller et al. ..... 239/533.12
6,513,724 B1 * 2/2003 Joseph et al. ..... 239/5

FOREIGN PATENT DOCUMENTS

JP 2659789 6/1997

* cited by examiner

*Primary Examiner*—Thomas N. Moulis
(74) *Attorney, Agent, or Firm*—Arent Fox PLLC

(57) ABSTRACT

A fuel injection valve includes a valve seat member, and an injector plate which is coupled to a front end face of the valve seat member and has a plurality of fuel injection orifices disposed about an axis of the valve seat member to communicate with a valve seat. Swirling means for swirling a fuel injected from each of the fuel injection orifices is provided in at least one of the valve seat member and the injector plate. The plurality of fuel injection orifices are disposed so that liquid membrane portions of adjoining hollow conical fuel spray forms formed by the fuel injected from the fuel injection orifices collide with one another. Thus, the atomization of the injected fuel can be further promoted, and a coalesced fuel spray form having a fuel particle density higher in a central zone and lower in an outer peripheral zone can be formed.

23 Claims, 13 Drawing Sheets

FUEL INJECTION VALVE

BACKGROUND OF THE INVENTION

1. Field of the Invention

The present invention relates to a fuel injection valve used mainly in a fuel-supplying system for an internal combustion engine, and particularly to an improvement in a fuel injection valve comprising a valve member, a valve seat member into a front end face of which a downstream end of a valve seat cooperating with the valve member opens, an injector plate coupled to the front end face of the valve seat member and having a plurality of fuel injection orifices which are disposed about an axis of the valve seat to communicate with the valve seat, in which a swirling means is provided in at least one of the valve seat member and the injector plate for swirling a fuel injected from each of the fuel injection orifices.

2. Description of the Related Art

A conventional fuel injection valve is already known, as disclosed, for example, in Japanese Patent No. 2659789.

The conventional fuel injection valve is designed to swirl a fuel injected from each of the fuel injection orifices, thereby promoting the atomization of the fuel. However, the conventional fuel injection valve has the following disadvantage: conical fuel spray forms formed by the fuel injected from the fuel injection orifices are directed in predetermined directions without interfering with one another, so that the fuel particle density of the each of the fuel spray forms tends to be lower in a central zone of the foam and higher in an outer peripheral zone of the foam, whereby a large amount of fuel is deposited to an inner wall of an intake passage to an engine.

SUMMARY OF THE INVENTION

Accordingly, it is an object of the present invention to provide a fuel injection valve, wherein the atomization of an injected fuel can be further promoted, and a coalesced fuel spray form having a fuel particle density higher in a central zone and lower in an outer peripheral zone can be formed.

To achieve the above object, according to a first feature of the present invention, there is provided a fuel injection valve comprising a valve member, a valve seat member into a front end face of which a downstream end of a valve seat cooperating with the valve member opens, an injector plate coupled to the front end face of the valve seat member and having a plurality of fuel injection orifices which are disposed about an axis of the valve seat to communicate with the valve seat, and swirling means provided in at least one of the valve seat member and the injector plate for swirling a fuel injected from each of the fuel injection orifices, wherein the plurality of fuel injection orifices are disposed so that liquid membrane portions of adjoining hollow conical fuel spray forms formed by a fuel injected from the fuel injection orifices collide with one another.

With the first feature, the fuel injected from plurality of the swirling chambers into the corresponding fuel injection orifices during opening of the fuel injection valve forms a plurality of hollow conical fuel spray forms under the action of an injection pressure and a centrifugal force, and liquid membrane portions of the adjoining fuel spray forms collide with one another, whereby the atomization of the fuel can be effectively promoted. Moreover, a single coalesced fuel spray form having a fuel density higher in a central zone and lower in an outer peripheral zone is formed finally and drawn into an engine along with intake air, while possibly preventing the fuel from being deposited on an inner wall of an intake passage to the engine. This can greatly contribute to an enhancement in startability of the engine and an improvement in mileage.

According to a second feature of the present invention, in addition to the first feature, the plurality of fuel injection orifices are disposed so that mutual collision between the adjoining hollow conical fuel spray forms occurs at a location spaced at a distance of 0.5 to 3.0 mm apart from an end face of the injector plate.

With the second feature, the liquid membrane portions of the adjoining hollow conical spray forms collide with one another in initial liquid membrane states. As a result, a liquid ligament state of the fuel is hastened, and hence the atomization of the fuel can be effectively promoted.

According to a third feature of the present invention, in addition to the first or second feature, the swirling means is formed so that the fuel injected from the fuel injection orifices is swirled in the same direction.

With the third feature, liquid membrane portions of the adjoining hollow conical fuel spray forms collide frontally with one another, whereby the atomization of the fuel can be more promoted.

According to a fourth feature of the present invention, in addition to the first or second feature, axes of the plurality of fuel injection orifices are disposed in parallel to one another.

With the fourth feature, the plurality of fuel injection orifices with their axes disposed in parallel to one another can be formed coaxially with one another by a high accuracy working, and a coalesced fuel spray form can be formed constantly and stably. This can contribute further to an enhancement in startability of the engine and an improvement in mileage.

According to a fifth feature, in addition to the second feature, a distance between the adjoining fuel injection orifices is equal to or smaller than 2.5 mm.

With the fifth feature, liquid membrane portions of the adjoining hollow conical fuel spray forms reliably and frontally collide with one another, whereby the atomization of the fuel can be effectively promoted. Finally, a single coalesced fuel spray form having a fuel density higher in a central zone and lower in an outer peripheral zone can be reliably formed.

According to a sixth feature of the present invention, in addition to the first or second feature, the injector plate has a thickness smaller than the inner diameter of the fuel injection orifices.

With the sixth feature, the apex angle of each of the hollow conical fuel spray forms generated from the fuel injection orifices can be sufficiently increased, whereby the force of mutual collision between the adjoining fuel spray forms can be increased, and thus the atomization of the fuel can be further promoted.

According to a seventh feature of the present invention, there is provided a fuel injection valve comprising a valve member, a valve seat member into a front end face of which a downstream end of a valve seat cooperating with the valve member opens, and an injector plate coupled to the front end face of the valve seat member, a transverse conduit communicating with the downstream end of the valve seat, a swirling chamber into which a downstream end of the transverse conduit opens in a tangent direction, the transverse conduit and the swirling chamber being formed between the valve member, the valve seat member and the injector plate, and a fuel injection orifice provided in the injector plate for injecting a fuel swirled in the swirling chamber, wherein the fuel injection orifice is disposed so that it is offset at a predetermined distance from a center of the swirling chamber toward an upstream end of the transverse conduit.

With the seventh feature, most of the fuel flowing from the transverse conduit into the swirling chamber is injected from the fuel injection orifice within substantially one swirl in the swirling chamber, and a fuel spray form formed by the injected fuel maintains a high swirling speed. Thus, the atomization of the fuel can be effectively promoted, and moreover the responsiveness of the fuel injection can be enhanced, thereby contributing to enhancements in startability and output performance of the engine and an improvement in mileage.

According to an eighth feature of the present invention, in addition to the seventh feature, the curvature of an inner peripheral surface of the swirling chamber is increased from an inlet side toward an outlet side of the chamber.

With the eighth feature, the swirling force of the fuel flowing from the transverse conduit into the swirling chamber is intensified as the fuel swirls along the inner peripheral surface of the swirling chamber. Therefore, the swirling speed of the fuel spray form generated from the fuel injection orifice can be increased, whereby the atomization of the fuel can be effectively promoted.

According to a ninth feature of the present invention, in addition to the eighth feature, the inner peripheral surface of the swirling chamber is formed along an involute curve having a basic circle in the swirling chamber.

With the ninth feature, the swirling force of the fuel flowing from the transverse conduit into the swirling chamber is intensified continuously and smoothly, as the fuel swirls along the inner peripheral surface of the swirling chamber. Therefore, a high swirling speed can be provided to the fuel spray form, to greatly contribute to the promotion of the atomization of the fuel.

According to a tenth feature of the present invention, in addition to the ninth feature, the basic circle is disposed concentrically with the fuel injection orifice and has a diameter smaller than that of the fuel injection orifice.

With the tenth feature, the fuel swirled in the swirling chamber can be injected smoothly from the fuel injection orifice, and a high swirling speed of the fuel spray form can be maintained, thereby greatly contributing to the promotion of the atomization of the fuel.

According to an eleventh feature of the present invention, in addition to any of the seventh to tenth features, the transverse conduit and the swirling chamber can be formed into slit-shapes in an intermediate plate coupled between the valve seat member and the injector plate.

With the eleventh feature, the transverse conduit and the swirling chamber can be formed easily in the intermediate plate by pressing or laser-cutting, thereby contributing to a reduction in cost.

According to a twelfth feature of the present invention, in addition to any of the seventh to tenth features, a plurality of the transverse conduits are disposed radially so that a tangent direction of each of the transverse conduits opening into the swirling chamber is regular, and a plurality of the fuel injection orifices opening into a plurality of the swirling chambers are disposed so that liquid membrane portions of adjoining hollow conical fuel spray forms generated by the fuel injected from the fuel injection orifices collide frontally with one another.

With the twelfth feature, the fuel injected from the plurality of swirling chambers into the corresponding fuel injection orifices forms a plurality of hollow conical fuel spray forms under the action of an injection pressure and a centrifugal force, and liquid membrane portions of the adjoining fuel spray forms collide frontally with one another, whereby the atomization of the fuel can be effectively promoted. Moreover, a single coalesced fuel spray form having a fuel density higher in a central zone and lower in an outer peripheral zone is finally formed and drawn along with intake air into an engine, while possibly preventing the fuel from being deposited on an inner wall of an intake passage to the engine. This can greatly contribute to enhancement in startability and output performance of the engine and an improvement in mileage.

According to a thirteenth feature of the present invention, in addition to any of the seventh to tenth features, the transverse conduit is formed so that its sectional area is decreased toward the swirling chamber.

With the thirteenth feature, when the fuel is passed through the transverse conduit, the flow rate of the fuel is increased as the fuel approaches the swirling chamber, and hence the swirling effect provided to the fuel in the swirling chamber can be further enhanced.

According to a fourteenth feature of the present invention, in addition to any of the seventh to tenth features, the injector plate has a thickness set to be smaller than the inner diameter of the fuel injection orifice.

With the fourteenth feature, the apex angle of hollow conical fuel spray forms generated from the fuel injection orifice can be sufficiently increased, whereby the force of mutual collision between the adjoining fuel spray forms can be increased, and thus the atomization of the fuel can be further promoted.

According to a fifteenth feature of the present invention, there is provided a fuel injection valve comprising a valve member, a valve seat member into a front end face of which a downstream end of a valve seat cooperating with the valve member opens, an injector plate coupled to the front end face of the valve seat member, aplurality of transverse conduits formed between the valve seat member and the injector plate to communicate with the downstream end of the valve seat and extend in a transverse direction substantially perpendicular to an axis of the valve seat, a plurality of swirling chambers which are formed between the valve seat member and the injector plate and into which downstream ends of the transverse conduits are open in tangent directions, and a plurality of fuel injection orifices provided in the injector plate for injecting a fuel swirled in the swirling chambers to the outside, wherein a plurality of side holes are provided between the valve seat and the plurality of transverse conduits, each of the side holes opening at one end into a peripheral edge of the downstream end of the valve seat, and being connected at the other end to an upstream end of each of the transverse conduits.

With the fifteenth feature, the fuel passed through the valve seat during opening of the valve is diverted immediately and equally into the transverse conduits through the plurality of side holes connected to the peripheral edge of the downstream end of the valve seat, to flow into the corresponding swirling chambers at a high speed in tangent directions, where the fuel flows are swirled. The fuel flows injected from the corresponding fuel injection orifices form uniform hollow conical fuel spray forms under the action of an injection pressure and a centrifugal force, whereby the atomization of the fuel can be promoted. Moreover, since the side holes individually leading to the transverse conduits open into the peripheral edge of the valve seat, the volume of a dead space occupied by the remaining fuel extending from the valve seat to each of the fuel injection orifices during closing of the valve can be reduced, thereby providing an improved accuracy in an amount of injected fuel while the fuel is dispensed equally into the swirling chambers.

According to a sixteenth feature of the present invention, in addition to the fifteenth feature, an intermediate plate is connected between the valve seat member and the injector plate; the transverse conduits and the swirling chambers are formed into groove-shapes in a face of the intermediate plate opposed to the injector plate; and the side holes are formed in the intermediate plate to penetrate the surface and back thereof.

With the sixteenth feature, the pluralities of side holes, transverse conduits and swirling chambers can be formed easily in the intermediate plate which is a small component by a high accuracy working. Moreover, groove-shaped transverse conduits and swirling chambers having different specifications can be formed in the intermediate plate having the same thickness by differentiating their groove widths and depths, thereby providing general-purpose properties.

According to a seventeenth feature of the present invention, in addition to the fifteenth or sixteenth feature, each of the swirling chambers is disposed radially outside the corresponding side hole with respect to the valve seat.

With the seventeenth feature, the swirling chambers and the fuel injection orifices can be provided in a relatively large number around the peripheries of the plurality of side holes, which is advantageous for a specification of a large fuel flow amount.

According to an eighteenth feature of the present invention, in addition to the fifteenth or sixteenth feature, each of the swirling chambers is disposed radially inside the corresponding side hole with respect to the valve seat.

With the eighteenth feature, a pitch circle of the plurality of fuel injection orifices can be sufficiently reduced, which is advantageous for a specification of a small fuel flow amount.

According to a nineteenth feature of the present invention, in addition to the fifteenth or sixteenth feature, a total opening area of the side holes is 1.5 times or more of a total opening area of the fuel injection orifices.

With the nineteenth feature, an amount of fuel injected from the fuel injection orifices during a full load can be ensured stably with a necessary minimum dead space volume without being influenced by throttling resistances of the side holes.

According to a twentieth feature of the present invention, in addition to the fifteenth or sixteenth feature, each of the side holes is inclined so that it is displaced radially outwards of the valve seat as it approaches the corresponding transverse conduit.

With the twentieth feature, when the fuel is passed from each of the side holes to the corresponding transverse conduit, the flow of the fuel is smooth without a steep bending provided thereto, leading to a less speed loss of the fuel. Therefore, it is possible to enhance a swirling effect for the fuel in each of the swirling chambers.

According to a twenty first feature of the present invention, in addition to the fifteenth or sixteenth feature, each of the transverse conduits is inclined with respect to a radius line of the valve seat passing through the center of the corresponding side hole, and the angular positions of the corresponding side hole and the corresponding swirling chamber with respect to the center of the valve seat are displaced from each other.

With the twenty first feature, even when there is a small difference in diameter between a pitch circle of the plurality of side holes and a pitch circle of the plurality of swirling chambers, the length of each of the transverse conduits can be set to be large. Thus, the introduction of a laminar flow of the fuel in a tangent direction to each of the swirling chambers can be properly conducted, and a good swirling effect for the fuel can be provided in each of the swirling chambers. In addition, fuel spray forms can be compactly formed, thereby contributing to the prevention of the deposition of the fuel to an inner wall of an intake port in the engine.

According to a twenty second feature of the present invention, in addition to the fifteenth or sixteenth feature, each of the transverse conduits is inclined so that it is displaced axially outwards as it approaches the corresponding swirling chamber.

With the twenty second feature, when the fuel flows from each of the side holes to the corresponding transverse conduit and the corresponding swirling chamber, the flow of the fuel is smooth without a steep bending provided thereto, leading to a less speed loss of the fuel. Therefore, it is possible to enhance swirling effect for the fuel in each of the swirling chambers.

According to a twenty third feature of the present invention, in addition to the fifteenth or sixteenth feature, the plurality of side holes are disposed in a zigzag manner on two inner pitch circles concentric with the valve seat, and the plurality of swirling chambers are disposed in a zigzag manner on two outer pitch circles concentric with and having diameters larger than those of the two inner pitch circles.

With the twenty third feature, the side holes, the swirling chambers and the fuel injection orifices can be provided in a larger number, which is advantageous for a specification of a large fuel flow amount.

The swirling means corresponds to a radial passage 38 and a swirling chamber 39 in each of embodiments of the present invention which will be described hereinafter.

The above and other objects, features and advantages of the invention will become apparent from the following description of the preferred embodiments taken in conjunction with the accompanying drawings.

DESCRIPTION OF THE PREFERRED EMBODIMENTS

The present invention will now be described by way of preferred embodiments with reference to the accompanying drawings.

First, a first embodiment of the present invention will be described with reference to FIGS. 1 to 7.

Figure 1:
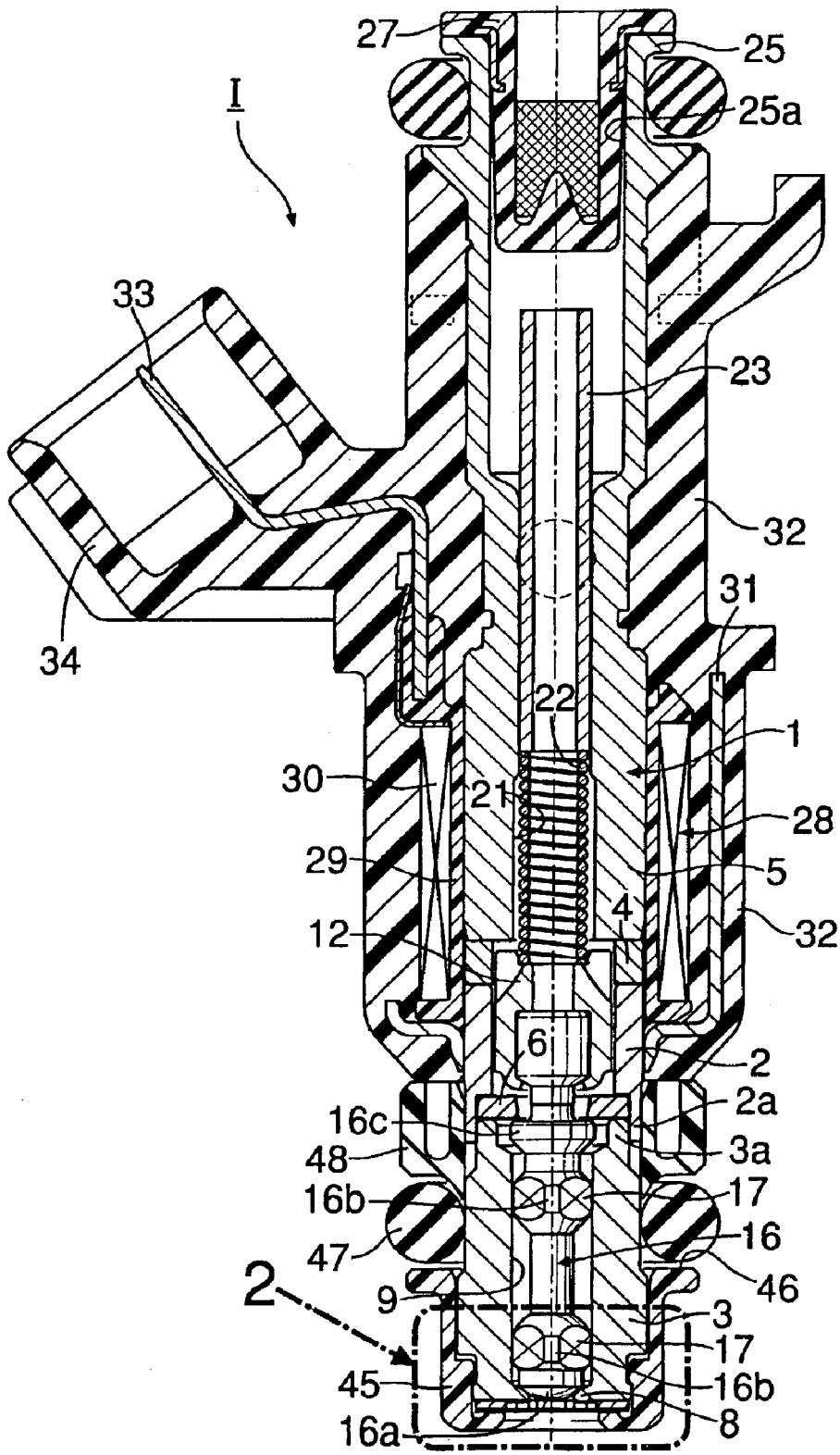
FIG. 1 is a vertical sectional view of a solenoid-type fuel injection valve for an internal combustion engine according to a first embodiment of the present invention.
Figure 2:
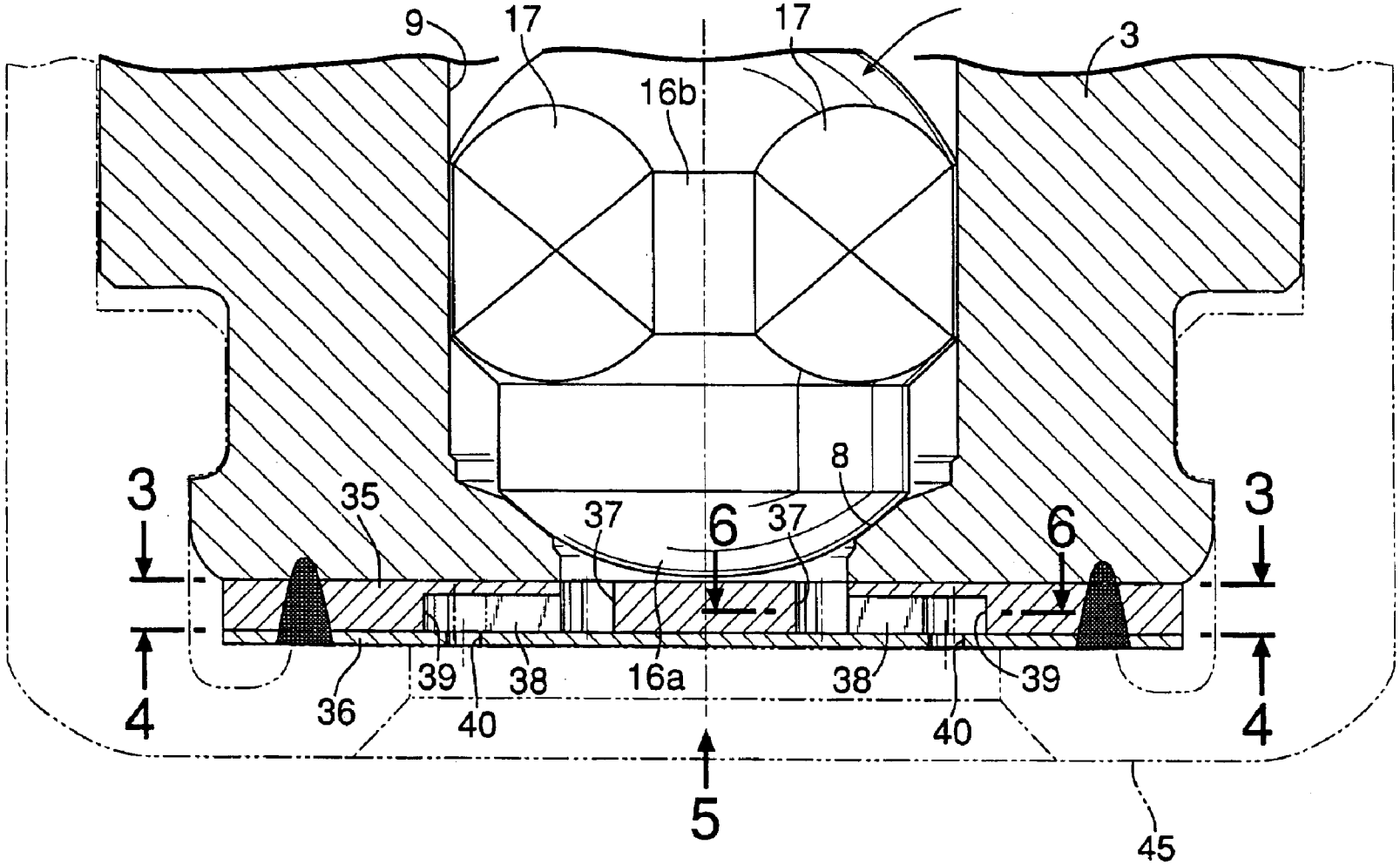
FIG. 2 is an enlarged view of essential portions of FIG. 1.
Figure 3:
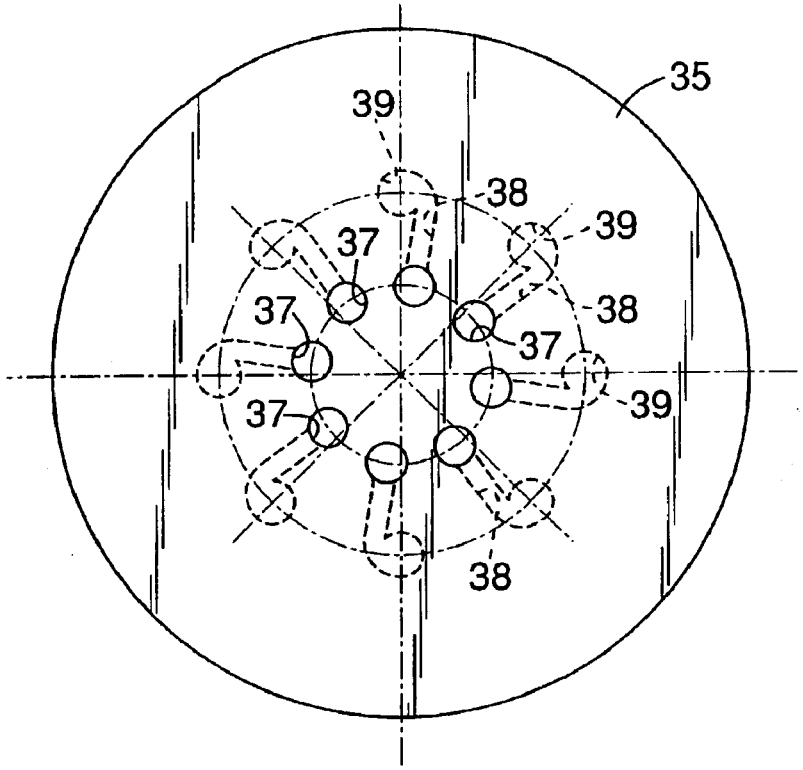
FIG. 3 is a sectional view taken along a line 3—3 in FIG. 2.
Figure 4:
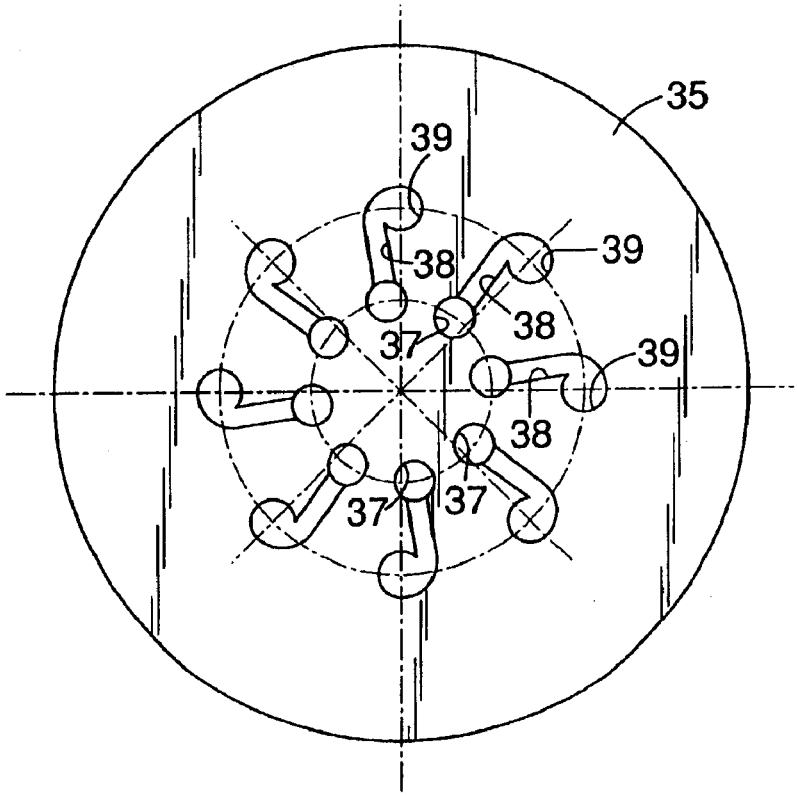
FIG. 4 is a sectional view taken along a line 4—4 in FIG. 2.

Referring to FIG. 1, a casing 1 of a solenoid-type electromagnetic fuel injection valve I for an internal combustion engine is comprised of a cylindrical valve housing 2 (made of a magnetic material), a bottomed cylindrical valve seat member 3 liquid-tightly coupled to a front end of the valve housing 2, and a cylindrical core 5 liquid-tightly coupled to a rear end of the valve housing 2 with an annular spacer 4 interposed therebetween.

The annular spacer 4 is made of a non-magnetic metal such as stainless steel, and the valve housing 2 and the stationary core 5 are butted against and liquid-tightly welded to opposite end faces of the annular spacer 4 over the entire periphery.

A first fitting tube 3*a* and a second fitting tube 2*a* are formed on opposed end faces of the valve seat member 3 and the valve housing 2, respectively. The first fitting tube 3*a* is press-fitted into the second fitting tube 2*a* along with a stopper plate 6, which is clamped between the valve housing 2 and the valve seat member 3. Thereafter, the valve housing 2 and the valve seat member 3 are liquid-tightly coupled to each other by a laser welding or beam welding carried out over the entire periphery of a corner sandwiched between an outer periphery surface of the first fitting tube 3*a* and an end face of the second fitting tube 2*a*.

The valve seat member 3 is provided at its front end face with a conical valve seat 8 which opens at its downstream end, and a cylindrical guide bore 9 connected to an upstream end, i.e., a larger-diameter portion of the valve seat 8. The guide bore 9 is formed coaxially with the second fitting tube 2*a*.

A movable core 12 is slidably received in the valve housing 2 and the annular space 4 and opposed to a front end of the stationary core 5. A valve member 16 axially slidably received in the guide bore 9 is integrally coupled to the movable core 12. The valve member 16 is integrally provided with a spherical valve portion 16*a* capable of being seated on the valve seat 8, a pair of front and rear journal portions 16*b* , 16*b* slidably carried in the guide bore 9, and a flange 16*c* adapted to abut against the stopper plate 6 to define an opening limit for the valve member 16. A plurality of chamfers 17 are provided on each of the journal portions 16*b* to enable the flowing of a fuel.

The stationary core 5 has a hollow 21 communicating with the interior of the valve housing 2. The hollow 21 accommodates a coil-shaped valve spring 22 for biasing the movable core 12 in a direction to close the valve member 16, i.e., toward a direction to seat on the valve seat 8, and a pipe-shaped retainer 23 for supporting a rear end of the valve spring 22.

An inlet tube 25 is integrally connected to a rear end of the stationary core 5, and has a fuel inlet 25*a* communicating with the hollow 21 in the stationary core 5 through the pipe-shaped retainer 23. A fuel filter 27 is mounted in the fuel inlet 25*a*.

A coil assembly 28 is fitted over outer peripheries of the annular spacer 4 and the stationary core 5. The coil assembly 28 comprises a bobbin 29 fitted over the outer peripheries of the annular spacer 4 and the stationary core 5, and a coil 30 wound around the bobbin 29. One end of a coil housing 31 surrounding the coil assembly 28 is coupled by welding to an outer peripheral surface of the valve housing 2.

The coil housing 31, the coil assembly 28 and the stationary core 5 are embedded in a cover 32 made of a synthetic resin. A coupler 34 is integrally connected to an intermediate portion of the cover 32, and accommodates a connecting terminal 33 leading to the coil 30.

As shown in FIGS. 2 to 5, an injector plate 36 made of a steel plate is liquid-tightly welded over the entire periphery to a front end face of the valve seat member 3 with an intermediate plate 35 likewise made of a steel plate being interposed therebetween. Provided in the intermediate plate 35 are a large number of side holes 37 arranged at equal intervals around an axis of the valve seat 8 to extend axially from a peripheral edge of a downstream end of the valve seat 8, a large number of transverse conduits 38 extending radially outwards, i.e., radially from the side holes 37, and a large number of swirling chambers 39 into which downstream ends of the transverse conduits 38 open in tangent directions. The side holes 37, the transverse conduits 38 and the swirling chambers 39 are provided in slit-shapes so that they penetrate a surface and back of the intermediate plate 35. Thus, the transverse conduits 38 and the swirling chambers 39 can be formed easily in the intermediate plate 35 by a pressing or a laser cutting, leading to a reduction in cost.

The swirling chambers 39 are also arranged at equal intervals about the axis of the valve seat 8. The tangent directions in which the transverse conduits 38 open into the swirling chambers 39 are regular, so that a direction of the swirling provided to the fuel in each of the swirling chambers 39 is regular.

A large number of fuel injection orifices 40 are provided in the injector plate 36 to open into the large number of swirling chambers 39, respectively. The injector plate 36 has a thickness smaller than the inner diameter of each of the fuel injection orifices 40, and the fuel injection orifices 40 are disposed so that their exes are parallel to the axis of the valve seat 8.

Figure 6:
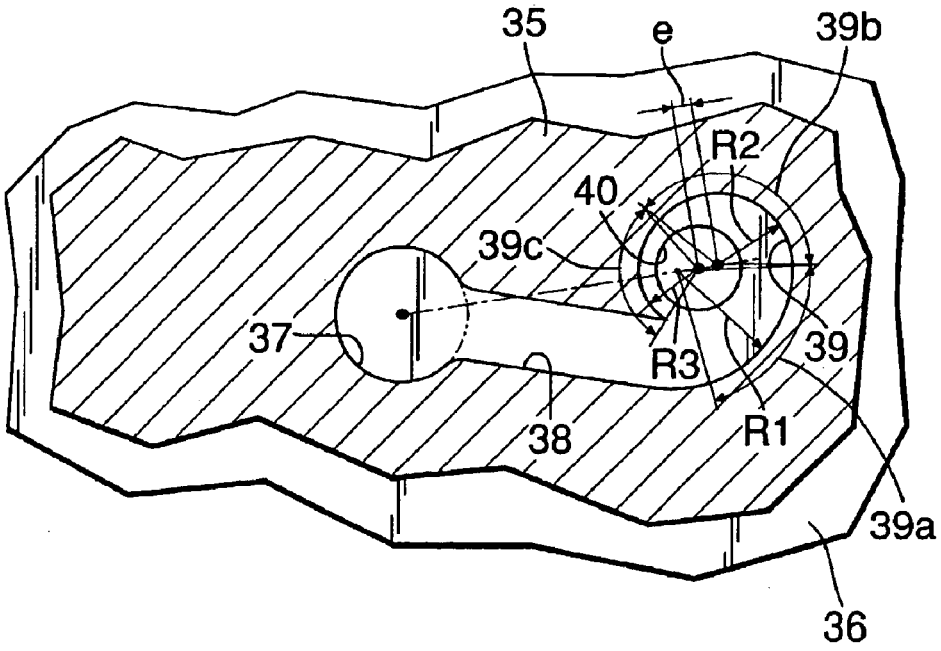
FIG. 6 is an enlarged sectional view taken along a line 6—6 in FIG. 2.

As clearly shown in FIG. 6, an inner peripheral surface of each of the swirling chambers 39 is divided into a plurality of regions: an inlet region 39*a*, an intermediate region 39*b* and an outlet region 39*c* in the swirling direction of the fuel. These regions have radii R1, R2 and R3 of curvature which are decreased in the named order, namely, R1>R2>R3. Therefore, the curvature of the inner peripheral surface of each swirling chamber 39 is increased from the inlet side toward the outlet side of the chamber 39.

Figure 5:
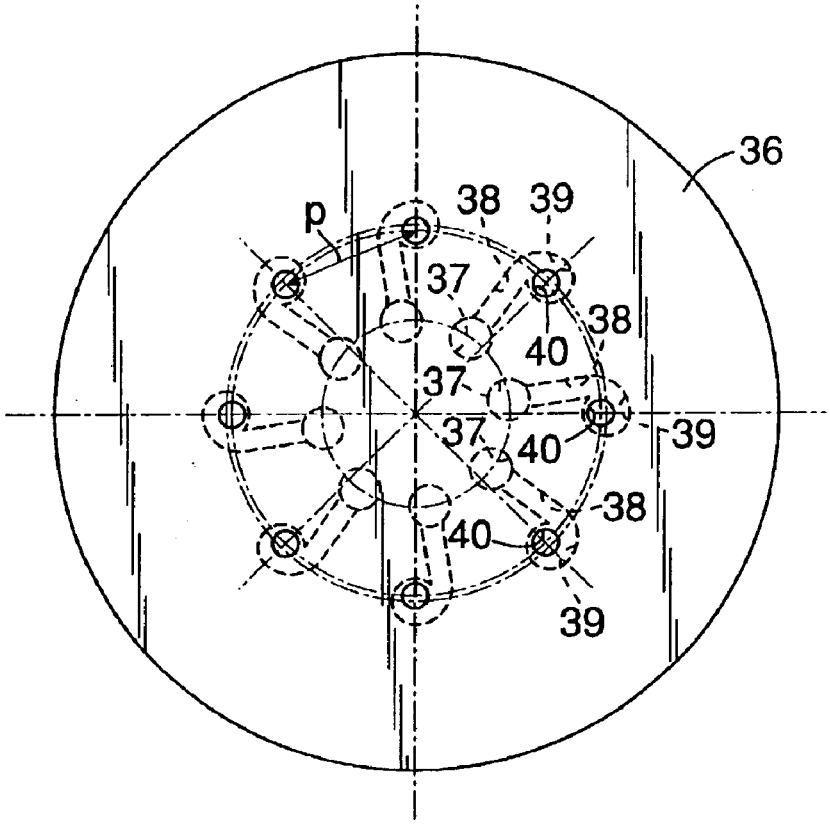
FIG. 5 is a view taken in a direction of an arrow 5 in FIG. 2.

Each of the fuel injection orifices 40 is disposed in such a manner that it is offset by a predetermined distance e from the center of the corresponding swirling chamber 39 toward an upstream end of the corresponding transverse conduit 38. The large number of fuel injection orifices 40 are disposed so that an interval p between the adjoining fuel injection orifices 40 is equal to or smaller than 2.5 mm, as shown in FIG. 5.

Referring again to FIG. 1, an annular seal holder 48 is fitted over the outer peripheries of the valve housing 2 and the valve seat member 3 to extend astride them. An annular groove 46 is defined between the seal holder 48 and a cap 45 made of a synthetic resin and fitted over the front end of the valve seat member 3. An O-ring 47 is mounted in the annular groove 46 to come into close contact with the outer peripheral surface of the valve seat member 3. The O-ring 47 is adapted to come into close contact with an inner peripheral surface of a fuel-injection-valve mounting bore in an intake manifold (not shown), when the solenoid-type fuel injection valve I is mounted in the mounting bore.

The operation of the first embodiment will be described below.

In a state in which the coil 30 has been deexcited, the movable core 12 and the valve member 16 are urged forwards by a biasing force of the valve spring 22, whereby the valve portion 16*a* of the valve member 16 is seated on the valve seat 8. Therefore, a high-pressure fuel supplied through the fuel filter 27 and the inlet tube 26 into the valve housing 2 is left on standby within the valve housing 2.

When the coil 30 is excited by supplying electric current thereto, a magnetic flux generated thereby runs sequentially through the stationary core 5, the coil housing 31, the valve housing 2 and the movable core 12, whereby the movable core 12 is attracted to the stationary core 5 along with the valve member 16 by a magnetic force to open the valve seat 8. Therefore, the high-pressure fuel in the valve housing 2 is passed via the chamfers 17 of the valve member 16 and the valve seat 8, and then transferred from the peripheral edge of the valve set 8 to the large number of side holes 37 while maintaining a high speed. Thereafter, the high-pressure fuel flows from the side holes 37 via the corresponding transverse conduits 38 into the corresponding swirling chambers 39 in the tangent directions at the high speed. Thus, the fuel is swirled at a high speed in each of the swirling chambers 39, whereby a swirling force is imparted to the fuel.

Especially, the swirling force of the fuel is intensified, as the fuel flowing into each of the swirling chambers 39 swirls along the inner peripheral surface of the chamber 39, because the curvature of the inner peripheral surface of each swirling chamber 39 is increased from the inlet side toward the outlet side of the chamber 39.

Each of the fuel injection orifices 40 is disposed in such a manner that it is offset by the predetermined distance e from the center of each of the swirling chambers 39 toward the upstream end of the corresponding transverse conduit 38, and hence most of the fuel flowing into each of the swirling chambers 39 is injected from the fuel injection orifice 40 within one swirl in the swirling chamber 39, and hence the speed loss of the fuel in the swirling chamber 39 is small.

As a result, the fuel injected from each of the swirling chambers 39 into the corresponding fuel injection orifice 40 forms a hollow conical fuel spray form F1 under the action of a large injection pressure and a centrifugal force, and a high swirling speed can be maintained. Therefore, the atomization of the fuel can be promoted more effectively, and moreover the responsiveness of the fuel injection can be enhanced.

Figures 15A, 15B, 15C:
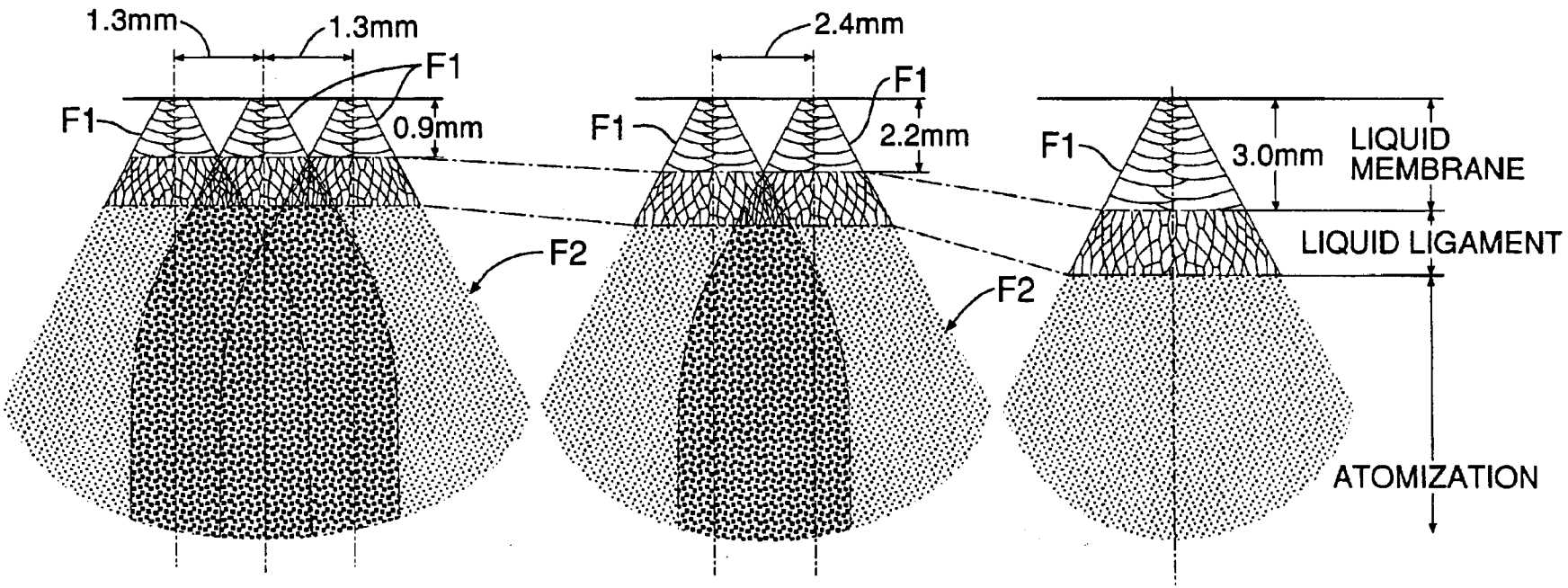
FIG.15A PRIOR ART
FIG. 15 is a diagram for explaining the comparison between a fuel spray form (A) in the prior art and fuel spray forms (B), (C) according to the present invention.
Figure 16:
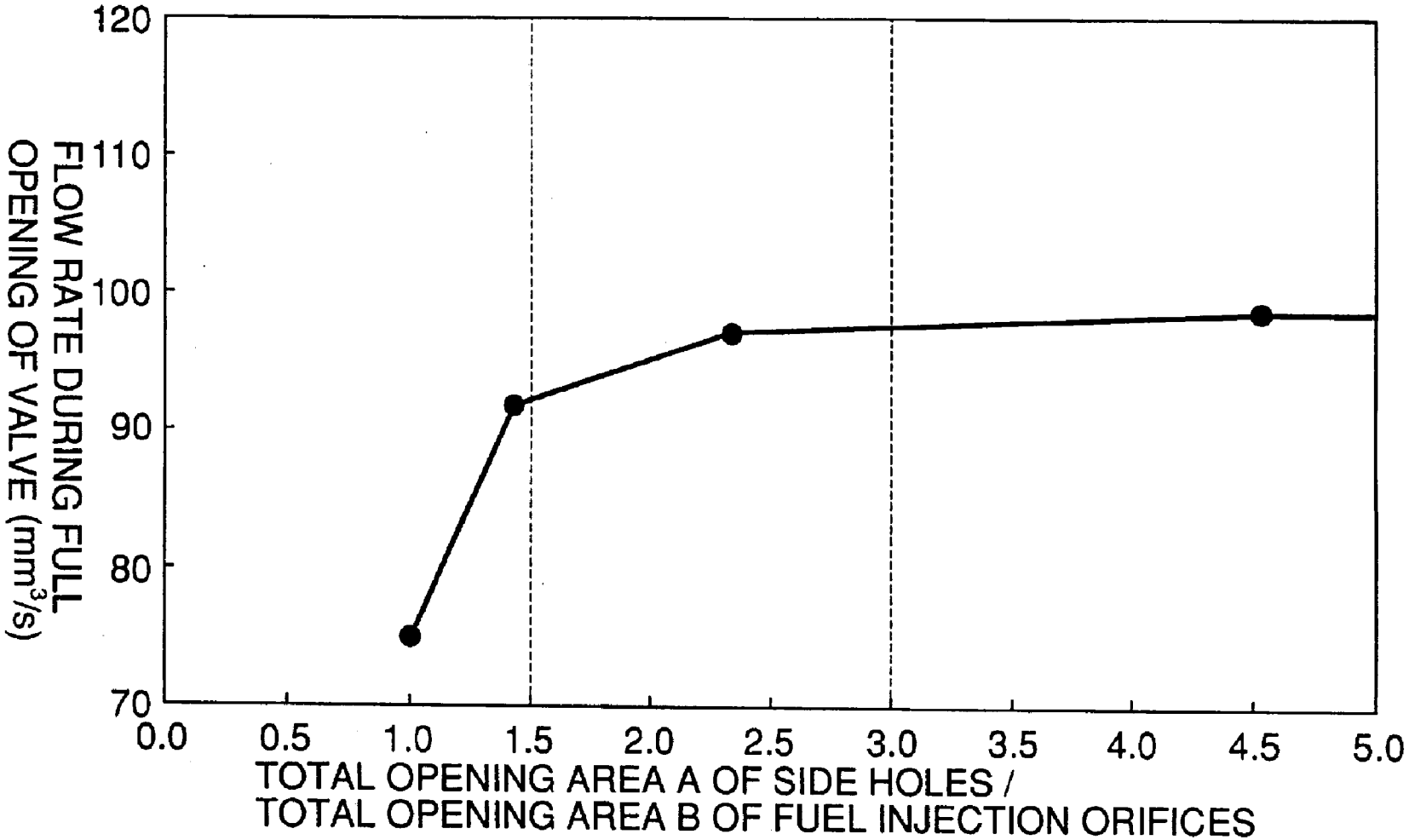
FIG. 16 is a diagram made based on a test and showing the relationship between the magnification of a total opening area A of side holes with respect to a total opening area B of fuel injection orifices and the maximum amount of injected fuel.

FIG. 15(A) shows a state of the fuel spray form F1 formed in a test using a single fuel injection orifice 40; FIG. 15 (B) shows states of fuel spray forms F1 and F2 formed in a test in which a distance between the two fuel injection orifices 40, 40 was set to be 2.4 mm; and FIG. 15(C) shows states of fuel spray forms F1 and F2 formed in a test in which distances between three adjoining fuel injection orifices 40, 40, 40 were set to be 1.3 mm.

Figure 7:
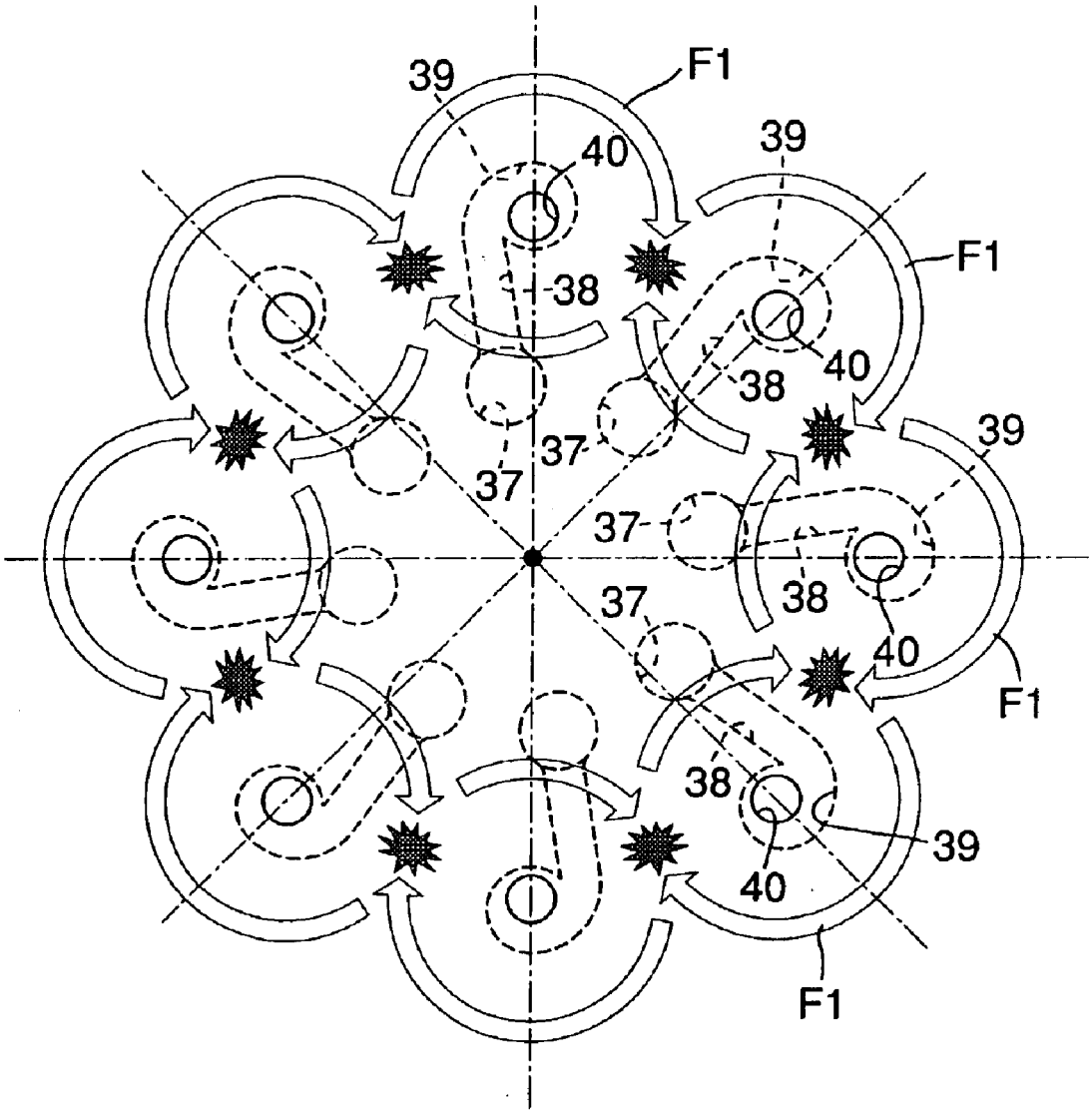
FIG. 7 is a view similar to FIG. 5 for explaining the operation.

As shown in FIG. 15(A), the hollow conical fuel spray form F1 produced from the single fuel injection orifice 40 assumes a laminar liquid membrane state immediately after the fuel exits from the fuel injection orifice 40, and then assumes an atomized state via a liquid ligament state. In the first embodiment, however, liquid membrane portions of the large number of hollow conical fuel spray forms F1, which adjoin each other in the liquid membrane states, collide frontally with each other in the liquid membrane states, as shown in FIG. 7 and FIGS. 15(B) and 15(C), because the large number of fuel injection orifices 40 are disposed so that an interval p between the adjoining fuel injection orifices 40 is equal to or smaller than 2.5 mm, and the fuel is swirled in the same direction within each of the swirling chambers 39. As a result, the entering the liquid ligament states by all the fuel spray forms F1 are hastened, and accordingly the atomization of the fuel can be effectively promoted. Moreover, as a result of the mutual frontal collision between the liquid membrane portions of the large number of fuel spray forms F1, a single coalesced fuel spray form F2 having a fuel density higher in a central zone and lower in an outer peripheral zone is finally formed. The single fuel spray form F2 is drawn along with intake air into the engine, while possibly preventing the fuel from being deposited on an inner wall of an intake passage to the engine. This can greatly contribute to enhancements in startability and output performance of the engine and an improvement in mileage.

It could be confirmed by the test that terminal ends of the liquid membrane states of the large number of the fuel spray forms F1 are in a region spaced at a distance of 0.5 to 3.0 mm apart from the injector plate 36, and if the large number of fuel spray forms F1 collide with one another in this region, the atomization of the fuel can be effectively promoted. To achieve such mutual collision between the fuel spray forms F1, it was significantly effective to set the distance between the adjoining fuel injection orifices 40 at a value equal to or smaller than 2.5 mm, as described above.

In addition, since the thickness of the injector plate 36 is set to be smaller than of the inner diameter of each of the fuel injection orifices 40, the apex angle of each of the hollow conical fuel spray forms F1 can be sufficiently increased, whereby the force of mutual collision between the liquid membrane portions of the adjoining fuel spray forms F1 can be increased, and thus the atomization of the fuel can be further promoted.

Further, since the axes of the large number of fuel injection orifices 40 are disposed in parallel to one another, these fuel injection orifices 40 can be formed coaxially with a high accuracy. As a result, the fuel spray forms F1 generated from all the fuel injection orifices 40 can be always made uniform, and the coalesced fuel spray form F2 which is formed constantly and stably by the mutual frontal collision between the liquid membrane portions of the fuel spray forms F1. This can further contribute to improvements in startability and output performance of the engine as well as an improvement in mileage.

The large number of swirling chambers 39 are arranged annularly on a pitch circle concentric with and larger than a pitch circle of the group of the side holes 37 arranged annularly. Therefore, the swirling chambers 39 and the fuel injection orifices 40 can be provided in a relatively large number around the periphery of the group of the side holes 37, which is advantageous for a specification of a large fuel flow amount.

Figure 8:
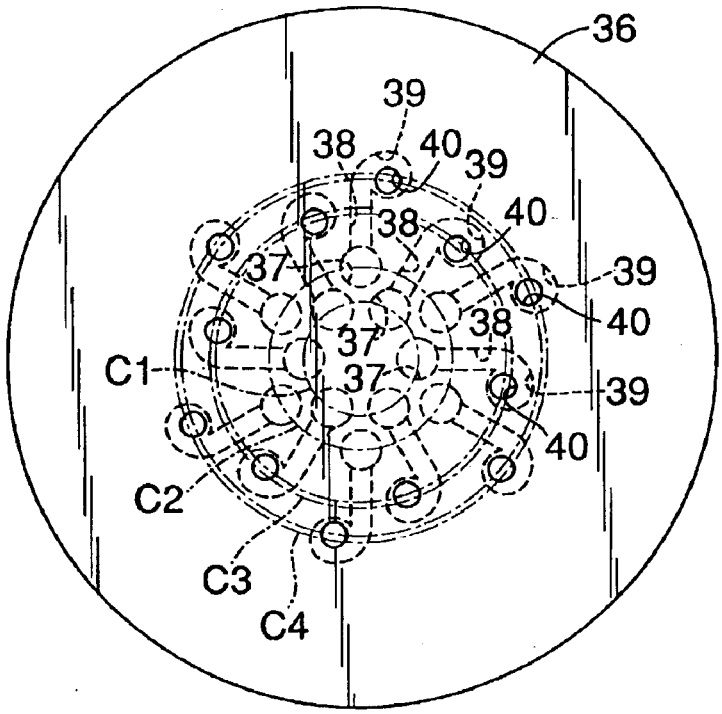
FIG. 8 is a view similar to FIG. 5 but showing a second embodiment of the present invention.

A second embodiment of the present invention shown in FIG. 8 will now be described.

The second embodiment has the same arrangement as that in the first embodiment, except that a large number of side holes 37 are disposed in a zigzag manner on two concentric pitch circles C1 and C2, and accordingly a large number of swirling chambers 39 are disposed in a zigzag manner on two pitch circles C3 and C4 larger in diameter than and concentric with the pitch circles C1 and C2. Therefore, portions or components corresponding to those in the previous embodiment are designated by the same reference numerals and symbols in FIG. 8, and the description of them is omitted.

According to the second embodiment, the side holes 37, the swirling chambers 39 and the fuel injection orifices 40 can be provided in a larger number, which is advantageous for a specification of a larger fuel flow amount.

Figure 9:
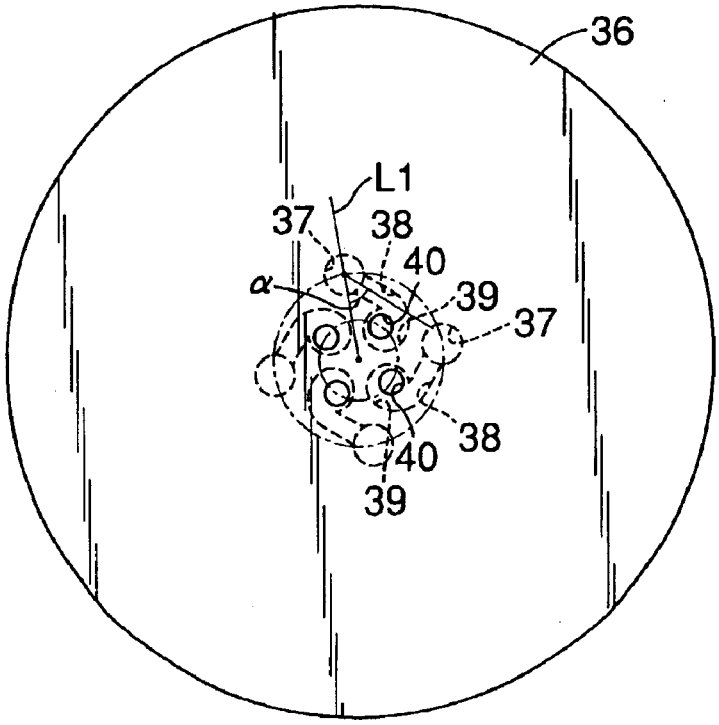
FIG. 9 is a view similar to FIG. 5 but showing a third embodiment of the present invention.

A third embodiment of the present invention shown in FIG. 9 will now be described.

In the third embodiment, a plurality of swirling chambers 39 are arranged annularly on a pitch circle concentric with and smaller than a pitch circle of the group of side holes 37 arranged annularly. Each of transverse conduits 38 is inclined at an angle $\alpha$ with respect to a radius line L1 of a valve seat 8 passing through the center of the corresponding side hole 37, and the angular positions of the corresponding side hole 37 and the corresponding swirling chamber 39 with respect to the center of the valve seat 8 are displaced from each other. The arrangement of the other components is the same as that in the first embodiment, and hence portions or components corresponding to those in the first embodiment are designated by the same reference numerals and symbols in FIG. 9.

According to the third embodiment, the swirling chambers 39 and fuel injection orifices 40 cannot be provided very in a very large number, but the size of the pitch circle of the group of the fuel injection orifices 40 can be sufficiently reduced, which is advantageous for a specification of a small fuel flow amount. Even when there is a small difference in diameter between the pitch circle of the group of the side holes 37 and the pitch circle of the group of the swirling chambers 39, the length of each of transverse conduits 38 can be set to be large, and the introduction of a laminar flow of the fuel in a tangent direction into each of the swirling chambers 39 can be properly conducted, thereby providing a good fuel-swirling effect in each of the swirling chambers 39. In addition, each of fuel spray forms F1 and F2 can be compactly formed, whereby the deposition of the fuel to an inner wall of an intake port in an engine can be prevented. This is advantageous for a small-sized engine.

Figure 10:
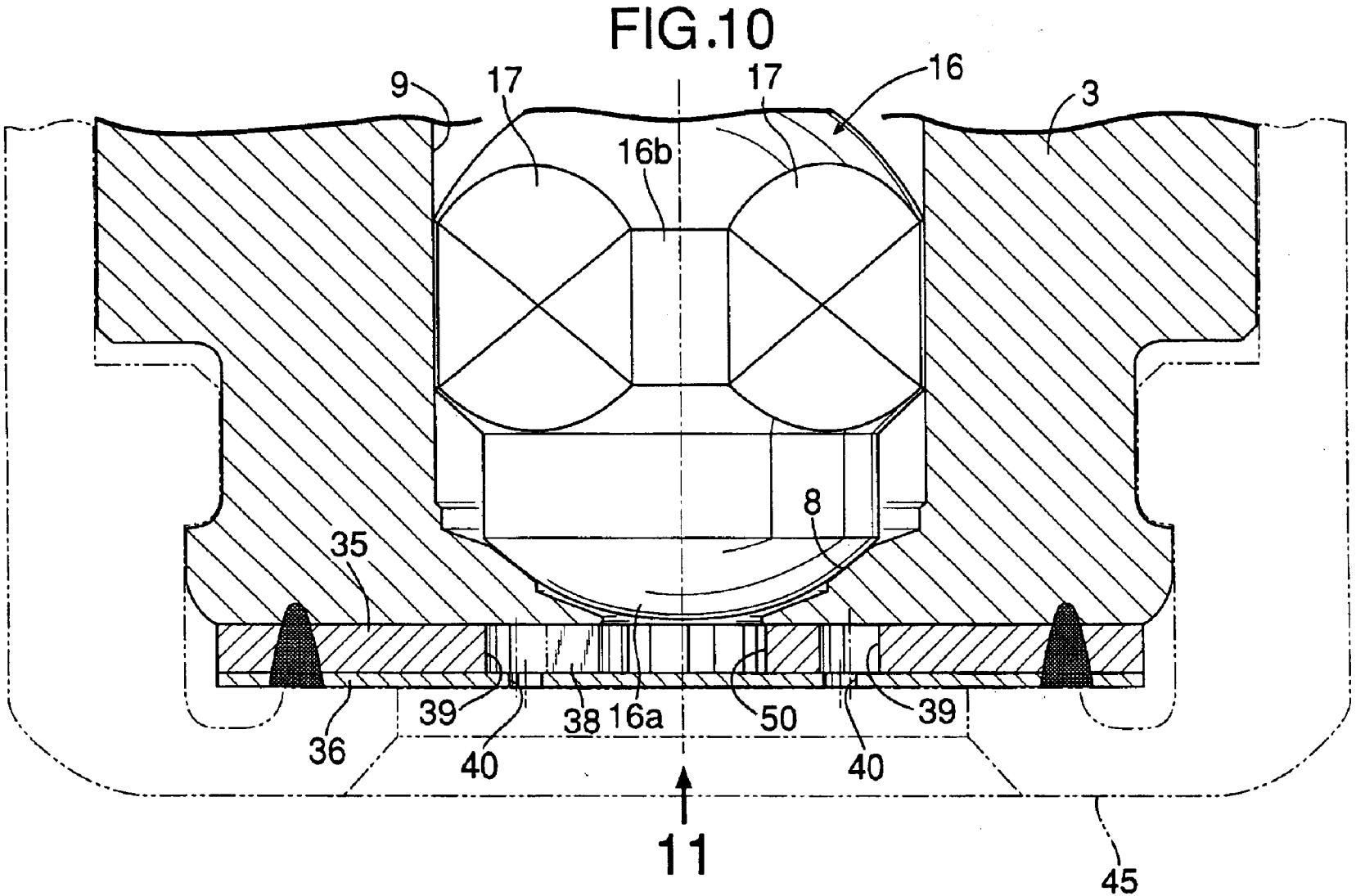
FIG. 10 is a view similar to FIG. 2 but showing a fourth embodiment of the present invention.
Figure 11:
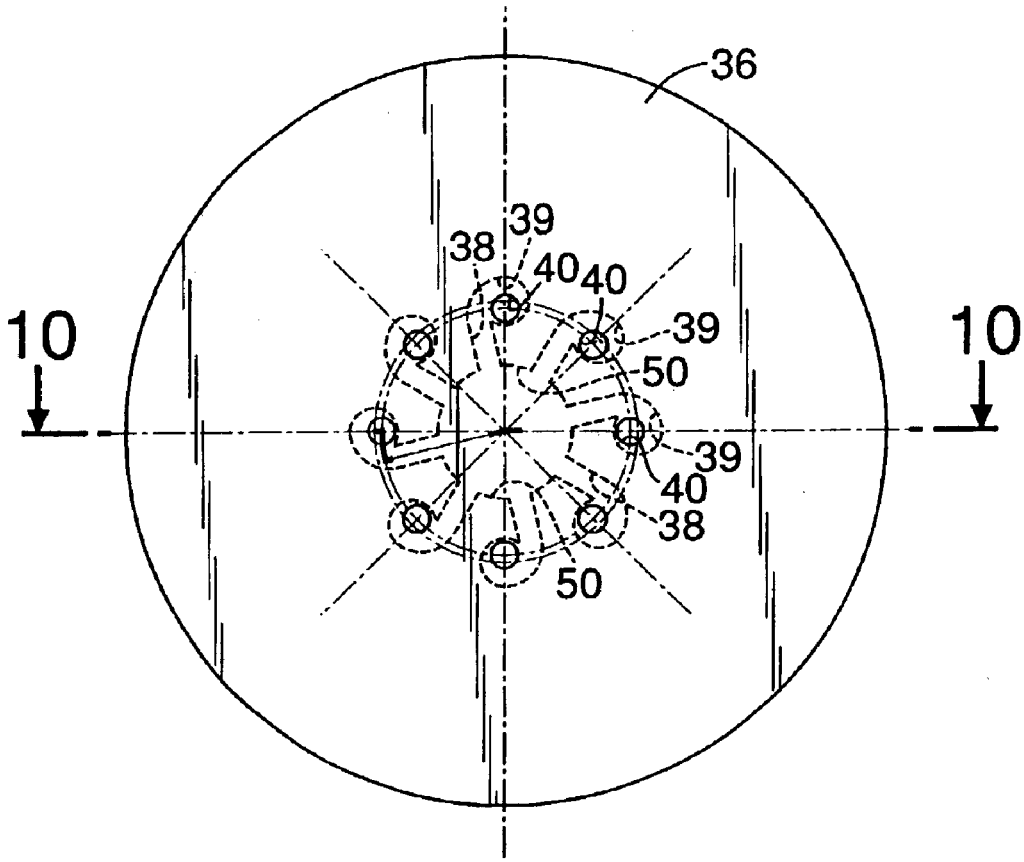
FIG. 11 is a view taken in a direction of an arrow 11 in FIG. 10.

A fourth embodiment of the present invention shown in FIGS. 10 and 11 will now be described.

The fourth embodiment has the same arrangement as that in the first embodiment, except that a circular dispensing chamber 50 is defined in the intimidate plate 35 to lead to a downstream end edge of a valve seat 8, and a large number of transverse conduits 38 are extended radially from an outer periphery of the dispensing chamber 50 to reach a large number of swirling chambers 39. Therefore, portions or components corresponding to those in the first embodiment are designated by the same reference numerals and symbols in FIGS. 10 and 11, and the description of them is omitted.

According to the fourth embodiment, the fuel is dispensed from the common dispensing chamber 50 into the large number of transverse conduits 38, and hence a large number of side holes 37 as in the first embodiment are not required, which can contribute to the simplification of a structure. However, the volume of the common dispensing chamber 50 is larger than the total volume of the side holes 37 of the first embodiment, which is less advantageous for reducing dead volume, as compared with the first embodiment.

Figure 12:
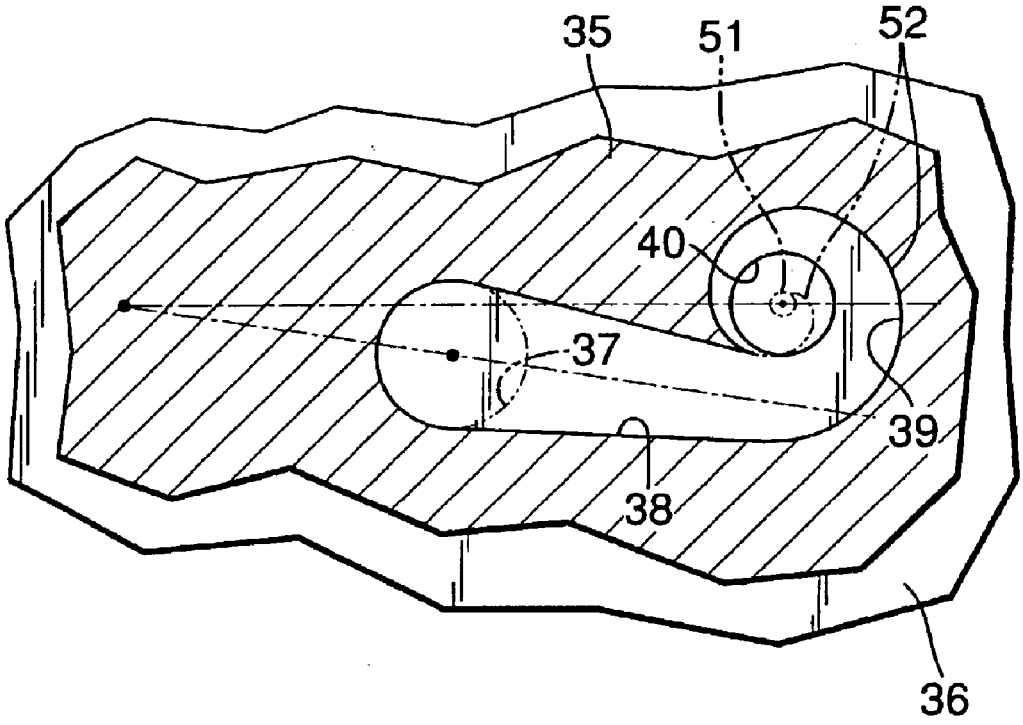
FIG. 12 is a view similar to FIG. 6 but showing a fifth embodiment of the present invention.

A fifth embodiment of the present invention shown in FIG. 12 will now be described.

In the fifth embodiment, the sectional area of a transverse conduit 38 extending from each of side holes 37 to corresponding one of swirling chambers 39 is reduced gradually in a downstream direction, i.e., toward the swirling chamber 39. An inner peripheral surface of each of the swirling chambers 39 is formed along an involute curve 52 having a basic circle 51 disposed concentrically with a fuel injection orifice 40, and is formed to have a diameter smaller than that of the fuel injection orifice 40. The arrangement of the other components is the same as that in the first embodiment, and hence portions or components corresponding to those in the first embodiment are designated by the same reference numerals and symbols, and the description of them is omitted.

According to the fifth embodiment, the flow rate of a fuel flowing from each of the side holes 37 into the transverse conduit 38 is increased as the fuel approaches the corresponding swirling chamber 39, and hence the swirling effect provided to the fuel in the swirling chamber 39 can be enhanced. At the same time, the swirling force of the fuel can be intensified continuously and smoothly, as the fuel flowing from the transverse conduit 38 into the swirling chambers 39 swirls along the inner peripheral surface of the swirling chambers 39, whereby a high swirling speed can be provided to a fuel spray form, to greatly contribute to the promotion of the atomization of the fuel.

Figure 13:
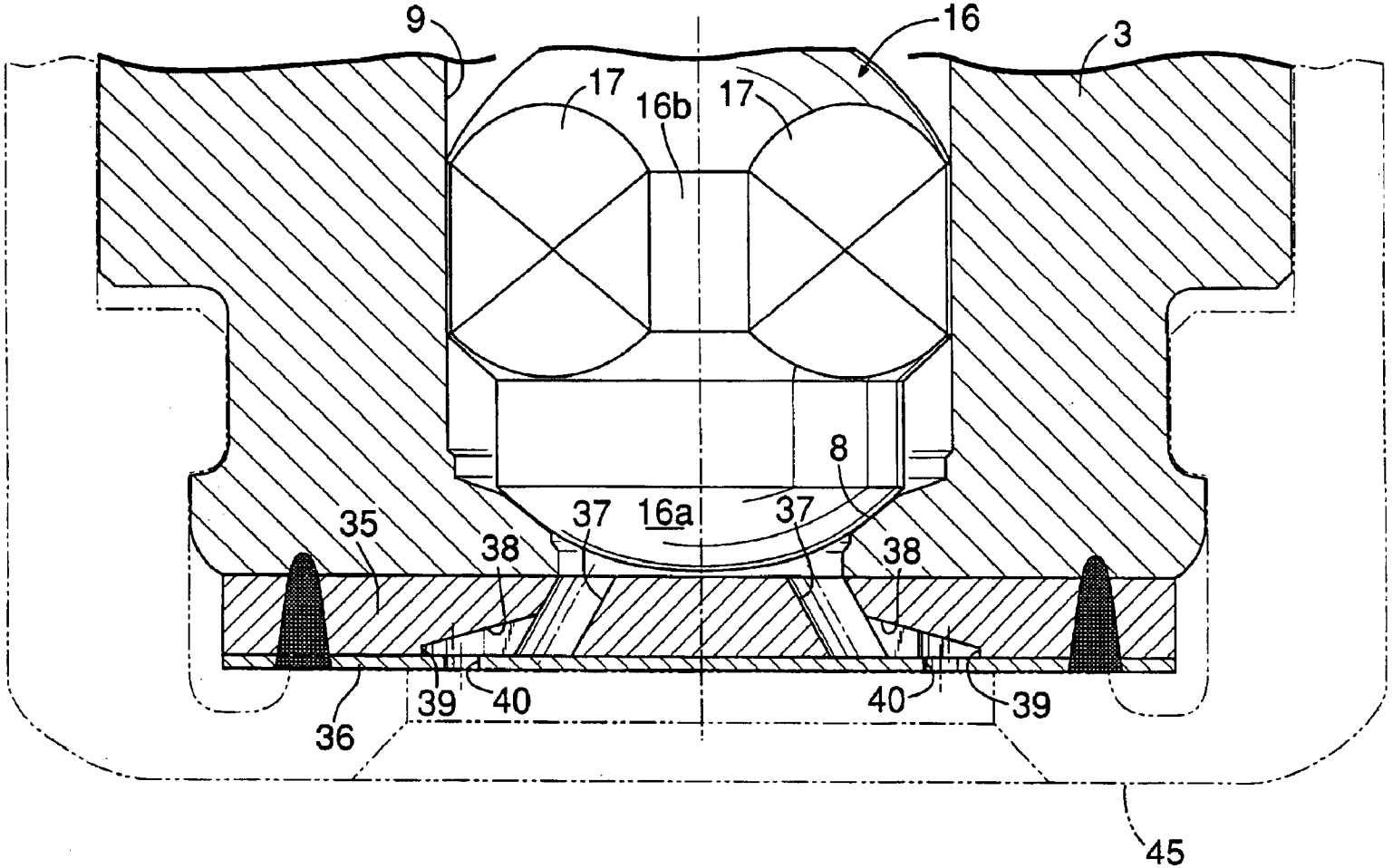
FIG. 13 is a view similar to FIG. 2 but showing a sixth embodiment of the present invention.

A sixth embodiment of the present invention shown in FIG. 13 will now be described.

A large number of side holes 37 are provided in an intermediate plate 35 at equal intervals about an axis of a valve seat 8, to extend axially from a peripheral edge of a downstream end of the valve seat 8 so as to penetrate a surface and a back of the intermediate plate 35. The intermediate plate 35 is also provided, in its face opposed to an injector plate 36, with a large number of groove-shaped transverse conduits 38 extending radially outwards from the side holes 37 in a radial direction of the valve seat 8, and a large number of groove-shaped swirling chambers 39 into which downstream end of the transverse conduits 38 open in tangent directions. Each of the transverse conduits 38 and the swirling chambers 39 is formed into a groove-shaped.

In this case, preferably, each of the side holes 37 is disposed in an inclined manner so that it is displaced in the radially outward direction of the valve seat 8, as approaching the corresponding transverse conduit 38, and each of the transverse conduit 38 is disposed in an inclined manner so that it is displaced axially outwards, as approaching the corresponding swirling chamber 39.

If a total opening area of the large number of side holes 37 in the intermediate plate 35 is represented by A, and a total opening area of the large number of fuel injection orifices 40 in the injector plate 36 is represented by B, the side holes 37 and the fuel injection orifices 40 are formed so that an equation, A/B=1.5 to 3.0 is established.

The arrangement of the other components is the same as that in the first embodiment, and hence portions or components corresponding to those in the first embodiment are designated by the same reference numerals and symbols, and the description of them is omitted.

As described above, when each of the side holes 37 is disposed in an inclined manner so that it is displaced radially outwards of the valve seat 8, as approaching the corresponding transverse conduit 38, and each of the transverse conduits 38 is disposed in an inclined manner so that it is displaced axially outwards, as approaching the corresponding swirling chamber 39, the flow of the fuel through each of the side holes 37 and each of the transverse conduits 38 to the swirling chamber 39 is smoothened without a steep bending provided thereto, leading to a less speed loss of the fuel.

In addition, the large number of side holes 37 individually leading to the large number of transverse conduits 38 open into a peripheral edge of the valve seat 8, and hence it is possible to decrease the volume of a dead space occupied by the remaining fuel and expending from the valve seat 8 to each of the fuel injection orifices 40 during closing of the fuel injection valve. This can contribute to an enhancement in accuracy in amount of injected fuel. Especially, if each of the side holes 37 and each of the fuel injection orifices 40 are formed so that the equation, A/B=1.5 to 3.0 is established, as described above, an amount of injected fuel from each of the fuel injection orifices 40 during a full load can be stably ensured with a necessary minimum volume of a dead space without being influenced by a contraction resistance of each side hole 37.

The large number of transverse conduits 38 and the large number of swirling chambers 39 are formed into the groove-shapes in the face of the intermediate plate 35 opposed to the injector plate 36, and the large number of side holes 37 are formed in the injector plate 36 to penetrate the surface and back of the injector plate 36. Therefore, it is possible to easily form by a high accuracy working the pluralities of side holes 37, transverse conduits 38 and swirling chambers 39 in the intermediate plate 35 which is a small component. Moreover, groove-shaped transverse conduits and swirling chambers having different specifications can be formed in the intermediate plate having the same thickness by differentiating their groove widths and depths, thereby providing general-purpose properties.

Figure 14:
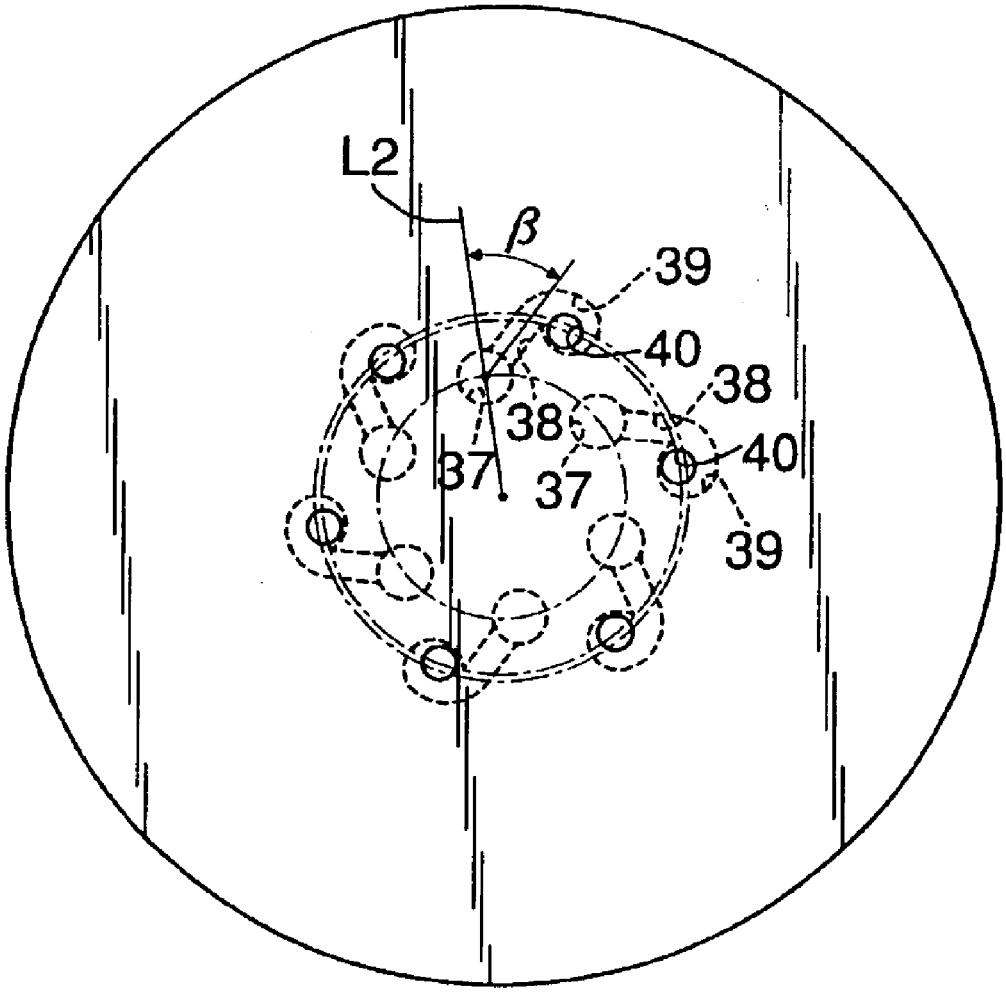
FIG. 14 is a view similar to FIG. 5 but showing a seventh embodiment of the present invention.

A seventh embodiment of the present invention shown in FIG. 14 will now be described.

The seventh embodiment has the same arrangement as that in the first embodiment, except that each of transverse conduits 38 is inclined at an angle β with respect to a radius line L2 of a valve seat 8 passing through the center of the corresponding one of side holes 37, and angular positions of the corresponding side holes 37 and a corresponding swirling chamber 39 with respect to the center of the valve seat 8 are displaced from each other. Therefore, portions or components corresponding to those in the first embodiment are designated by the same reference numerals and symbols in FIG. 14, and the description of them is omitted.

According to the seventh embodiment, even when there is a small difference in diameter between a pitch circle of the group of the side holes 37 and a pitch circle of the group of the swirling chambers 39, the length of each of the transverse conduits 38 can be set to be large, and the introduction of the fuel in a tangent direction into each of the swirling chambers 39 can be properly conducted, thereby providing a good fuel-swirling effect in each of the swirling chambers 39.

It will be understood that the present invention is not limited to the above-described embodiments, and various modifications in design may be made without departing from the spirit and scope of the invention defined in the claims.

What is claimed is:

1. A fuel injection valve comprising a valve member, a valve seat member into a front end face of which a downstream end of a valve seat cooperating with said valve member opens, an injector plate coupled to the front end face of said valve seat member and having a plurality of fuel injection orifices which are disposed about an axis of said valve seat to communicate with said valve seat, and swirling means provided in at least one of said valve seat member and said injector plate for swirling a fuel injected from each of said fuel injection orifices, wherein said plurality of fuel injection orifices are disposed so that liquid membrane portions of adjoining hollow conical fuel spray forms formed by a fuel injected from said fuel injection orifices collide with one another.

2. A fuel injection valve according to claim 1, wherein said plurality of fuel injection orifices are disposed so that mutual collision between the adjoining hollow conical fuel spray forms occurs at a location spaced at a distance of 0.5 to 3.0 mm apart from an end face of the injector plate.

3. A fuel injection valve according to claim 1 or 2, wherein said swirling means is formed so that the fuel injected from said fuel injection orifices is swirled in the same direction.

4. A fuel injection valve according to claim 1 or 2, wherein axes of said plurality of fuel injection orifices are disposed in parallel to one another.

5. A fuel injection valve according to claim 2, wherein a distance between the adjoining fuel injection orifices is equal to or smaller than 2.5 mm.

6. A fuel injection valve according to claim 1 or 2, wherein said injector plate has a thickness smaller than the inner diameter of said fuel injection orifices.

7. A fuel injection valve comprising a valve member, a valve seat member into a front end face of which a downstream end of a valve seat cooperating with said valve member opens, and an injector plate coupled to the front end face of said valve seat member, a transverse conduit communicating with the downstream end of said valve seat, a swirling chamber into which a downstream end of said transverse conduit opens in a tangent direction, said transverse conduit and said swirling chamber being formed between said valve member, said valve seat member and said injector plate, and a fuel injection orifice provided in said injector plate for injecting a fuel swirled in said swirling chamber, wherein said fuel injection orifice is disposed so that it is offset at a predetermined distance from a center of said swirling chamber toward an upstream end of said transverse conduit.

8. A fuel injection valve according to claim 7, wherein the curvature of an inner peripheral surface of said swirling chamber is increased from an inlet side toward an outlet side of said chamber.

9. A fuel injection valve according to claim 8, wherein the inner peripheral surface of said swirling chamber is formed along an involute curve having a basic circle in said swirling chamber.

10. A fuel injection valve according to claim 9, wherein said basic circle is disposed concentrically with said fuel injection orifice and has a diameter smaller than that of said fuel injection orifice.

11. A fuel injection valve according to any of claims 7 to 10, wherein said transverse conduit and said swirling chamber are formed into slit-shapes in an intermediate plate coupled between said valve seat member and said injector plate.

12. A fuel injection valve according to any of claims 7 to 10, wherein a plurality of said transverse conduits are disposed radially so that a tangent direction of each of said transverse conduits opening into the swirling chamber is regular, and a plurality of said fuel injection orifices opening into a plurality of said swirling chambers are disposed so that liquid membrane portions of adjoining hollow conical fuel spray forms generated by the fuel injected from said fuel injection orifices collide frontally with one another.

13. A fuel injection valve according to any of claims 7 to 10, wherein said transverse conduit is formed so that its sectional area is decreased toward said swirling chamber.

14. A fuel injection valve according to any of claims 7 to 10, wherein said injector plate has a thickness smaller than the inner diameter of said fuel injection orifice.

15. A fuel injection valve comprising a valve member, a valve seat member into a front end face of which a downstream end of a valve seat cooperating with said valve member opens, an injector plate coupled to the front end face of said valve seat member, a plurality of transverse conduits formed between said valve seat member and said injector plate to communicate with the downstream end of said valve seat and extend in a transverse direction substantially perpendicular to an axis of said valve seat, a plurality of swirling chambers which are formed between said valve seat member and said injector plate and into which downstream ends of said transverse conduits are open in tangent directions, and a plurality of fuel injection orifices provided in said injector plate for injecting a fuel swirled in said swirling chambers to the outside, wherein a plurality of side holes are provided between said valve seat and said plurality of transverse conduits, each of said side holes opening at one end into a peripheral edge of the downstream end of said valve seat, and being connected at the other end to an upstream end of each of said transverse conduits.

16. A fuel injection valve according to claim 15, wherein an intermediate plate is connected between said valve seat member and said injector plate; said transverse conduits and said swirling chambers are formed into groove-shapes in a face of said intermediate plate opposed to said injector plate; and said side holes are formed in said intermediate plate to penetrate the surface and back thereof.

17. A fuel injection valve according to claim 15 or 16, wherein each of said swirling chambers is disposed radially outside the corresponding side hole with respect to said valve seat.

18. A fuel injection valve according to claim 15 or 16, wherein each of said swirling chambers is disposed radially inside the corresponding side hole with respect to said valve seat.

19. A fuel injection valve according to claim 15 or 16, wherein a total opening area of said side holes is 1.5 or more times of a total opening area of said fuel injection orifices.

20. A fuel injection valve according to claim 15 or 16, wherein each of said side holes is inclined so that it is displaced radially outwards of said valve seat as it approaches the corresponding transverse conduit.

21. A fuel injection valve according to claim 15 or 16, wherein each of said transverse conduits is inclined with respect to a radius line of said valve seat passing through the center of the corresponding side hole, and the angular positions of the corresponding side hole and the corresponding swirling chamber with respect to the center of said valve seat are displaced from each other.

22. A fuel injection valve according to claim 15 or 16, wherein each of said transverse conduits is inclined so that it is displaced axially outwards as it approaches the corresponding swirling chamber.

23. A fuel injection valve according to claim 15 or 16, wherein said plurality of side holes are disposed in a zigzag manner on two inner pitch circles concentric with said valve seat, and said plurality of swirling chambers are disposed in a zigzag manner on two outer pitch circles concentric with and having diameters larger than those of said inner two pitch circles.

* * * * *